US009683461B2

(12) United States Patent
Staehli et al.

(10) Patent No.: US 9,683,461 B2
(45) Date of Patent: Jun. 20, 2017

(54) GAS TURBINE ROTOR POSITIONING DEVICE

(71) Applicant: ALSTOM Technology Ltd, Baden (CH)

(72) Inventors: Felix Staehli, Baden (CH); Axel Haerms, Nussbaumen (CH); Dirk Matthes, Mellingen (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 468 days.

(21) Appl. No.: 14/254,971

(22) Filed: Apr. 17, 2014

(65) Prior Publication Data

US 2014/0311260 A1 Oct. 23, 2014

(30) Foreign Application Priority Data

Apr. 23, 2013 (EP) ..... 13164950

(51) Int. Cl.
*F01D 15/12* (2006.01)
*F01D 25/36* (2006.01)

(52) U.S. Cl.
CPC ..... *F01D 25/36* (2013.01); *Y10T 74/18056* (2015.01)

(58) Field of Classification Search
CPC ..... F01D 25/36; Y10T 74/18056
See application file for complete search history.

(56) References Cited

U.S. PATENT DOCUMENTS

| | | | | |
|---|---|---|---|---|
| 3,141,384 | A * | 7/1964 | Hoffman | F01B 9/08 91/178 |
| 3,791,231 | A * | 2/1974 | Geary | F01D 25/34 192/104 C |
| 4,090,409 | A * | 5/1978 | Ohleyer | F01D 25/34 415/1 |
| 4,193,739 | A | 3/1980 | Lucey | |
| 4,596,310 | A | 6/1986 | Hatakeyama et al. | |
| 4,919,039 | A * | 4/1990 | Nutter | F15B 15/061 74/578 |
| 9,353,839 | B2 * | 5/2016 | Bastier | F16H 35/00 |
| 2003/0066369 | A1 * | 4/2003 | Benda | F16H 61/32 74/335 |
| 2004/0000206 | A1 * | 1/2004 | Beale | B62M 9/04 74/150 |
| 2008/0245032 | A1 * | 10/2008 | Wegner | B65B 65/02 53/349 |

(Continued)

FOREIGN PATENT DOCUMENTS

| | | |
|---|---|---|
| EP | 1 749 979 | 2/2007 |
| EP | 2 495 553 | 9/2012 |

(Continued)

*Primary Examiner* — Jesse Bogue
(74) *Attorney, Agent, or Firm* — Buchanan Ingersoll & Rooney PC

(57) ABSTRACT

A device for positioning the rotor of a gas turbine by linearly actuating a piston rod that actuates on its end a ratched wheel that moves the rotor of the gas turbine. The device includes an eccentric wheel and a synchronous motor. The piston rod is moved through the eccentric wheel, which is connected to the synchronous motor. The device also includes an incremental counter controlling the angular position of the synchronous motor. The device can permit accurate positioning of the rotor for boroscopic inspection.

14 Claims, 1 Drawing Sheet

(56) References Cited

U.S. PATENT DOCUMENTS

| | | | | |
|---|---|---|---|---|
| 2010/0280733 | A1 | 11/2010 | Jordan, Jr. et al. | |
| 2012/0067164 | A1* | 3/2012 | Su | B25G 1/06 74/575 |
| 2012/0204395 | A1 | 8/2012 | Jones et al. | |
| 2012/0285226 | A1 | 11/2012 | Laurer et al. | |

FOREIGN PATENT DOCUMENTS

| | | | |
|---|---|---|---|
| JP | H10-169410 | A | 6/1998 |
| JP | 2000-337105 | A | 12/2000 |

* cited by examiner

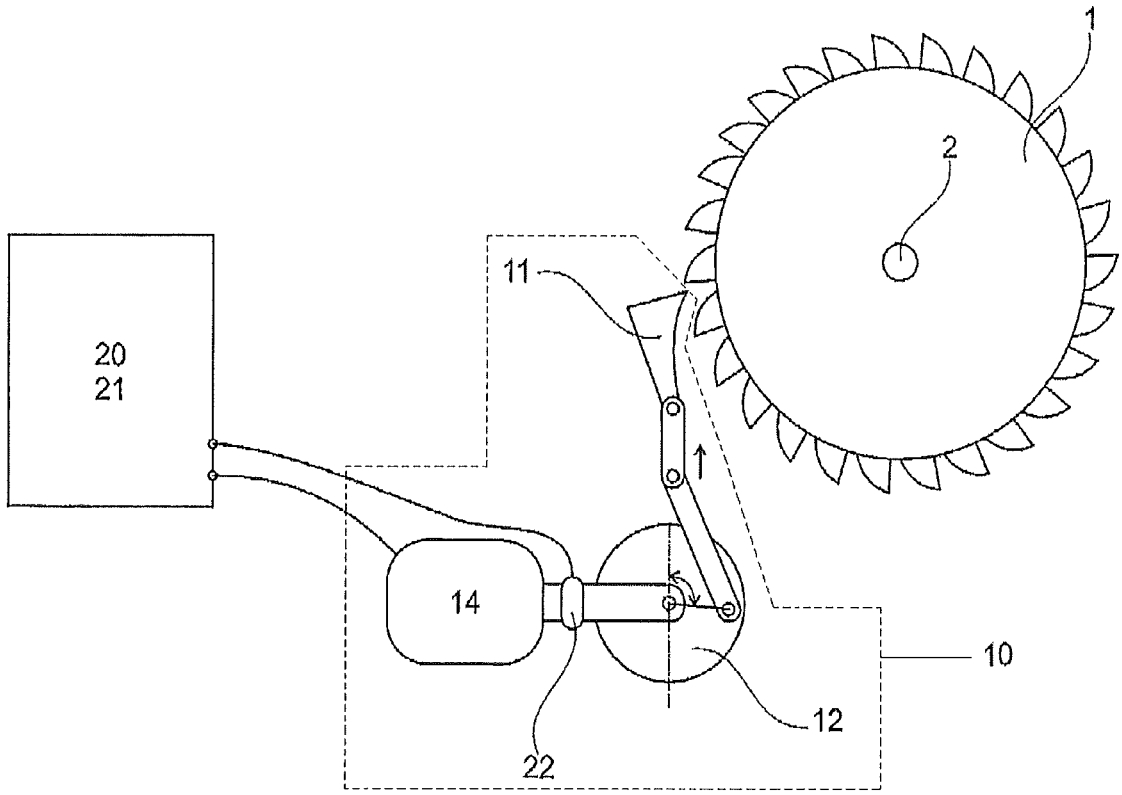
1
2
11
20
21
14
10
12
22

GAS TURBINE ROTOR POSITIONING DEVICE

CROSS-REFERENCE TO RELATED APPLICATIONS

This application claims priority to European application 13164950.1 filed Apr. 23, 2013, the contents of which are hereby incorporated in its entirety.

TECHNICAL FIELD

The present invention relates to an electromechanical device to position the rotor of a gas turbine in an accurate way.

BACKGROUND

During the useful life of a gas turbine, maintenance operations are necessary for guaranteeing the correct functioning of the turbine itself. During these periodical operations, controls and inspections are done and damaged or worn parts or components are substituted.

The parts of a turbine which are most subject to wear, are the turbine blades as they undergo mechanical stress at a high temperature and are also subject to hot corrosion due to the hot gases with which the turbine operates. Therefore, there exists the necessity of periodical inspections of the turbine blades to control their integrity and functionality. During programmed maintenance operations, in order to be able to inspect the blades of the turbine, it is usually necessary to rotate the blades of the turbine, which is done by rotating the whole turbine rotor. This is applied especially in the case of a boroscopic inspection where the turbine is decoupled from the generator, so that the blades can be inspected by means of a boroscope.

Large turbo machinery rotors, particularly of large gas turbines, need to be rotated at a very low rotational speed and to an exact position during boroscopic inspection in order to precisely carry out operations on the rotor, such as mechanical rotor maintenance, rotor balancing or rotor alignment. Typically, boroscopes are used for this kind of inspection work, where the area to be inspected is inaccessible by other means: boroscopes are optical devices comprising illuminating means for the illumination of the remote object to be inspected, such that an internal image of the illuminated object is obtained and is further magnified to be presented to the viewer's eyes.

Boroscopes are commonly used in the visual inspection of industrial gas turbines, as gas turbines require particular attention because of safety and maintenance requirements. Boroscope inspection can be used to prevent unnecessary maintenance, which can become extremely costly for large gas turbines.

Because of the reduced visibility, it is necessary to rotate the rotor (shaft) of the turbine to be able to inspect all of its blades. Typically, the rotor is manually actuated, as it is not accessible the shaft of the low pressure turbine is then rotated manually by acting on the portion of the turbine shaft which has been decoupled at the loading joint.

Different boroscope devices used for the inspection of turbomachines are known in the state of the art. For example, document EP 2495553 A2 discloses a portable boroscope assembly used for the inspection of turbomachine blades. Also known in the art is document US 2012/0204395 A1, disclosing a method for inspecting and/or repairing a component in a gas turbine engine, by using a boroscope.

Also, document US 2012/0285226 A1 discloses a system having a wear-indicating mark applied to a portion of surface of an internal component in a turbine, this mark being visually discernible through boroscopic inspection. Also known in the art, as per document EP 1749979 A2, is a system comprising a crank rotation mechanism having a reducer group for rotating, in particular manually, the shaft of the turbine to allow the inspection of blades by means of a boroscope. However, all these documents of the prior art that have been cited move the rotor (shaft) of the turbine manually, therefore being not accurate and being costly and time consuming.

Another system for rotating a shaft of a turbine, known in the art, is for example the one shown in document U.S. Pat. No. 4,193,739, where a device for turning a rotor of a gas turbine engine is disclosed for inspection purposes, comprising a nozzle that directs a jet of air onto the blades to turn the rotor. Also, the device comprises a rod that can move axially and that can stop the rotor. However, this system is not accurate and also requires human exertion, which makes it costly and time consuming. Also, this system is not able to provide a variable speed control on the rotor speed, in order to accurately effect boroscopic inspections in the gas turbine.

Also known in the art is document US 2010/0280733 A1, showing a gas turbine whose rotor speed is controlled by means of a controller, so that the shutdown of the rotor is controlled by controlling the rotor speed. Again, this kind of system cannot be properly used for accurate boroscopic inspection, where an accurate and specific positioning of the rotor is required. Moreover, boroscopic inspection requires variable speed (higher speed first and then, when a more accurate approach is done, a lower speed), which cannot be provided by this system.

For moving the rotor of a gas turbine it is also known to use a hydraulic device, typically a hydraulic cylinder, comprising a piston moving within the cylinder by the actuation of oil, typically. The unidirectional force obtained from this device actuates a rotor barring wheel having both a linear and radial movement. The problem of such a device is that, as it is actuated by oil, it is hard to control its movement. Also, oil is not the preferred actuating medium to use, as cleaning has to be done on a regular basis, which therefore requires time and extra cost.

Therefore, it is advantageous to provide a system for a gas turbine that is able to actuate the rotor of the gas turbine, such that the rotor can be remotely and automatically turned in variable speed and stopped at a specific and accurate position.

The present invention is directed towards providing these needs.

SUMMARY

The present invention relates to an electromechanical device for positioning the rotor of a gas turbine in an accurate way. The electromechanical device according to the invention comprises a drive mechanism with a linearly movable piston rod that actuates a ratched wheel for rotating, said ratched wheel being coupled to the rotor of the gas turbine. The electromechanical device of the invention also comprises an eccentric wheel and a drive means, such that the piston rod is moved through the eccentric wheel. A motion controller calculates the trigonometric trajectory conversion from the rotary movement of the drive means to the linear movement of the rod, and a motion controller calculates the torque which is needed for the defined linear force.

The device of the invention allows variable speed as well as force detection which is linearly exerted into the ratched wheel.

The rotary actuator of the device of the invention typically comprises a synchronous motor, allowing a precise control of its angular position.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings, wherein.

FIG. 1 shows a schematic view of the configuration of the electromechanical device for positioning the rotor of a gas turbine, according to the present invention within the gas turbine configuration.

DETAILED DESCRIPTION

The present invention relates to a device for positioning the rotor 2 of a gas turbine in an accurate way. The device comprises a piston rod 11 that linearly moves a ratched wheel 1 of which is moving the rotor 2 of the gas turbine. The drive mechanism 10 comprises an eccentric wheel 12 and a drive means, preferably a synchronous motor 14. The piston rod 11 is moved through the eccentric wheel 12, connected to the synchronous motor 14.

The synchronous motor 14 of the drive mechanism 10 allows a precise control of its angular position via the incremental counter 22.

The frequency converter 21 can vary the rotation speed of the synchronous motor 14 which determines the speed and position of the piston rod 11 as well as the output torque of the synchronous motor which allows a definition of the exerted linear force.

The trigonometric trajectory conversion from the rotary movement of the synchronous motor 14 to the linear movement of the piston rod 11 is calculated by a motion controller 20. The motion controller 20 also calculates the torque which is needed for the defined linear force.

Thanks to the positioning device according to this invention, the rotor 2 can be precisely adjusted in its circumferential position.

Some of the main advantages provided by the device of the invention are the following:

- a more accurate positioning of the rotor 2 is obtained;
- for proceeding boroscopic inspections, only one person is needed;
- the risks of injuries are highly minimized as nobody needs to act on the rotor 2 or turn it manually;
- hot boroscopic inspection could be done;
- the rotor 2 of the gas turbine can be turned in a more variable way.

Although the present invention has been fully described in connection with preferred embodiments, it is evident that modifications may be introduced within the scope thereof, not considering this as limited by these embodiments, but by the contents of the following claims.

The invention claimed is:

1. A device for positioning a rotor of a gas turbine, the device comprising:

a linearly movable rod that is moveable to actuate a ratched wheel coupled to the rotor of the gas turbine, the ratched wheel coupled to the rotor such that the rotor is rotatable via motion of the ratched wheel;

an eccentric wheel connected to the rod such that rotation of the eccentric wheel drives linear motion of the rod;

a motor connected to the eccentric wheel to rotate the eccentric wheel to drive linear motion of the rod;

a motion controller connected to the motor such that said motor is controlled by the motion controller, the motion controller configured to calculate a trigonometric trajectory conversion from rotary movement of the motor to linear movement of the rod, the motion controller also configured to calculate torque needed for linear force required for the linear movement of the rod to be driven via rotation of the eccentric wheel to be driven by the motor.

2. The device according to claim 1, wherein the motion controller comprises a frequency converter, which varies rotation speed of the motor to define a speed and stroke of the rod.

3. The device according to claim 2, wherein the frequency converter varies the output torque of the motor.

4. The device according to claim 1, wherein the motor is a synchronous motor.

5. The device according to claim 4, also comprising:

an incremental counter controlling an angular position of the synchronous motor.

6. The device according to claim 1, wherein an end of the rod is connected to the ratched wheel.

7. A gas turbine comprising a device according to claim 1.

8. The device according to claim 1, comprising:

a frequency converter connected to the motor to vary rotational speed of the motor;

an incremental counter connected to the motor, the incremental counter configured to facilitate control of an angular position of the motor.

9. The device according to claim 8, wherein the motor is a synchronous motor.

10. The device according to claim 8, wherein the ratched wheel encircles the rotor of the gas turbine.

11. A method of performing a boroscpic inspection of a gas turbine having a rotor, comprising:

providing the device of claim 1;

actuating the motor to rotate the rotor; and performing boroscopic inspection of the rotor.

12. The method of claim 11, wherein the rotor is rotated without rotation of the rotor being driven by a hydraulic cylinder.

13. The method of claim 11, wherein the device is an electromechanical device.

14. The method of claim 11, comprising:

adjusting a circumferential position of the rotor via the actuating of the motor to rotate the rotor.

* * * * *